US006969536B1

(12) United States Patent
Tuck et al.

(10) Patent No.: US 6,969,536 B1
(45) Date of Patent: Nov. 29, 2005

(54) METHOD OF CREATING A FIELD ELECTRON EMISSION MATERIAL

(75) Inventors: Richard Allan Tuck, Slough (GB); Adrian Burden, Didcot (GB); Hugh Bishop, Abingdon (GB); Christopher Hood, Reading (GB); Warren Lee, Reading (GB)

(73) Assignee: Printable Field Emitters Limited, Chilton (GB)

( * ) Notice: Subject to any disclaimer, the term of this patent is extended or adjusted under 35 U.S.C. 154(b) by 149 days.

(21) Appl. No.: 10/030,570

(22) PCT Filed: Jun. 30, 2000

(86) PCT No.: PCT/GB00/02537

§ 371 (c)(1),
(2), (4) Date: Jun. 4, 2002

(87) PCT Pub. No.: WO01/03154

PCT Pub. Date: Jan. 11, 2001

(30) Foreign Application Priority Data

Jul. 5, 1999 (GB) ..... 9915633

(51) Int. Cl.[7] ..... B05D 5/12

(52) U.S. Cl. ..... 427/77; 427/180; 427/203; 427/387; 427/421.1

(58) Field of Search ..... 427/77, 180, 387, 427/421.1, 203

(56) References Cited

U.S. PATENT DOCUMENTS 5,623,180 A * 4/1997 Jin et al. ..... 313/310
5,821,685 A * 10/1998 Peterson ..... 313/467
5,900,301 A * 5/1999 Brandes et al. ..... 428/77
5,977,697 A * 11/1999 Jin et al. ..... 313/310
6,250,984 B1 * 6/2001 Jin et al. ..... 445/51

* cited by examiner

*Primary Examiner*—Brian K. Talbot
(74) *Attorney, Agent, or Firm*—Barnes & Thornburg

(57) ABSTRACT

A field electron emission material is created by applying a silica precursor to graphite particles (11); processing the silica precursor to produce amorphous silica (12) which is doped and/or is heavily defective, and disposing the graphite particles (11) upon an electrically conductive surface (14) of a substrate (13) such that they are at least partially coated with the amorphous silica (12).

38 Claims, 5 Drawing Sheets

METHOD OF CREATING A FIELD ELECTRON EMISSION MATERIAL

Figure 1:
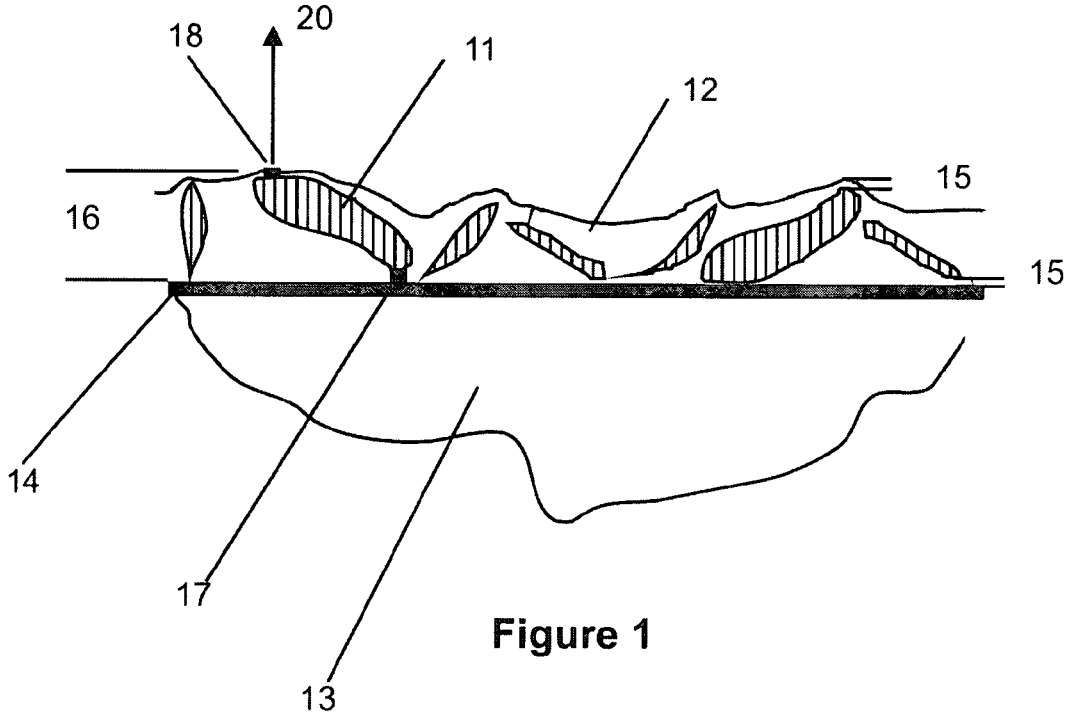

This invention relates to field electron emission materials, and devices using such materials.

In classical field electron emission, a high electric field of, for example, $\approx 3\times10^9$ V $m^{-1}$ at the surface of a material reduces the thickness of the surface potential barrier to a point at which electrons can leave the material by quantum mechanical tunnelling. The necessary conditions can be realised using atomically sharp points to concentrate the macroscopic electric field. The field electron emission current can be further increased by using a surface with a low work function. The metrics of field electron emission are described by the well-known Fowler-Nordheim equation.

There is considerable prior art relating to tip based emitters, which term describes electron emitters and emitting arrays which utilise field electron emission from sharp points (tips). The main objective of workers in the art has been to place an electrode with an aperture (the gate) less than 1 $\mu$m away from each single emitting tip, so that the required high fields can by achieved using applied potentials of 100V or less—these emitters are termed gated arrays. The first practical realisation of this was described by C A Spindt, working at Stanford Research Institute in California (*J. Appl. Phys.* 39, 7, pp 3504–3505, (1968)). Spindt's arrays used molybdenum emitting tips which were produced, using a self masking technique, by vacuum evaporation of metal into cylindrical depressions in a $SiO_2$ layer on a Si substrate.

In the 1970s, an alternative approach to produce similar structures was the use of directionally solidified eutectic alloys USE). DSE alloys have one phase in the form of aligned fibres in a matrix of another phase. The matrix can be etched back leaving the fibres protruding. After etching, a gate structure is produced by sequential vacuum evaporation of insulating and conducting layers. The build up of evaporated material on the tips acts as a mask, leaving an annular gap around a protruding fibre.

An important approach is the creation of gated arrays using silicon micro-engineering. Field electron emission displays utilising this technology are being manufactured at the present time, with interest by many organisations worldwide.

Major problems with all tip-based emitting systems are their vulnerability to damage by ion bombardment, ohmic heating at high currents and the catastrophic damage produced by electrical breakdown in the device. Making large area devices is both difficult and costly.

In about 1985, it was discovered that thin films of diamond could be grown on heated substrates from a hydrogen-methane atmosphere, to provide broad area field emitters—that is, field emitters that do not require deliberately engineered tips.

In 1991, it was reported by Wang et al (*Electron. Lett.,* 27, pp 1459 –1461 (1991)) that field electron emission current could be obtained from broad area diamond films with electric fields as low as 3 MV $m^{-1}$. This performance is believed by some workers to be due to a combination of the low electron affinity of the (111) facets of diamond and the high density of localised, accidental graphite inclusions (Xu, Latham and Tzeng: *Electron. Lett.*, 29, pp 1596–159 (1993)) although other explanations are proposed.

Coatings with a high diamond content can now be grown on room temperature substrates using laser ablation and ion beam techniques. However, all such processes utilise expensive capital equipment and the performance of the materials so produced is unpredictable.

S I Diamond in the USA has described a field electron emission display (FED) that uses as the electron source a material that it calls Amorphic Diamond. The diamond coating technology is licensed from the University of Texas. The material is produced by laser ablation of graphite onto a substrate.

From the 1960s onwards another group of workers has been studying the mechanisms associated with electrical breakdown between electrodes in vacuum. It is well known (Latham and Xu, *Vacuum*, 42, 18, pp 1173–1181 (1991)) that as the voltage between electrodes is increased no current flows until a critical value is reached at which time a small noisy current starts flowing. This current increases both monotonically and stepwise with electric field until another critical value is reached, at which point it triggers an arc. It is generally understood that the key to improving voltage hold-off is the elimination of the sources of these pre-breakdown currents. Current understanding shows that the active sites are metal-insulator-vacuum (MIV) structures formed by either embedded dielectric particles or conducting flakes sitting on insulating patches such as the surface oxide of the metal. In both cases, the current comes from a hot electron process that accelerates the electrons resulting in quasi-thermionic emission over the surface potential barrier. This is well described in the scientific literature e.g. Latham, *High Voltage Vacuum Insulation, Academic Press* (1995). Although the teachings of this work have been adopted by a number of technologies (e.g. particle accelerators) to improve vacuum insulation, until recently little work has been done to create field electron emitters using the knowledge.

Latham and Mousa (*J. Phys. D: Appl Phys.* 19, pp 699–713 (1986)) describe composite metal-insulator tip-based emitters using the above hot electron process and in 1988 S Bajic and R V Latham, (*Journal of Physics D Applied Physics*, vol 21 200–204 (1988)), described a composite that created a high density of metal-insulator-metal-insulator-vacuum (MIMIV) emitting sites. The composite had conducting particles dispersed in an epoxy resin. The coating was applied to the surface by standard spin coating techniques.

Much later in 1995 *Tuck, Taylor and Latham* (GB 2304989) improved the above MIMIV emitter by replacing the epoxy resin with an inorganic insulator that both improved stability and enabled it to be operated in sealed off vacuum devices.

The teachings of Tuck, Taylor and Latham (GB 2304989) suggest that MIMIV emission is a general property of inorganic insulator layers containing conducting particles. To a degree this is true, but there is still considerable demand for identifying combinations of particle and insulator materials for which the electric field required to obtain emission, the emission site density thus obtained and the overall uniformity are generally acceptable for use in electronic devices.

Preferred embodiments of the present invention provide combinations of particle and insulator materials and morphologies which have turned out to have surprisingly good properties for field electron emission.

According to one aspect of the present invention, there is provided a method of creating a field electron emission material, comprising the steps of:

applying a silica precursor to graphite particles;

processing said silica precursor to produce amorphous silica which is doped and/or is heavily defective; and disposing said graphite particles upon an electrically conductive surface of a substrate such that they are at least partially coated with said amorphous silica.

In the context of this specification, the term "heavily defective" as applied to silica means silica in which the band edges are diffuse with a plurality of states that may, or may not, be localised such that they extend into the band-gap to facilitate the transport of carriers by hopping mechanisms.

Said graphite particles may be formed as particle-like projections or tips fabricated on said conductive surface. Otherwise, said graphite particles are loose particles.

A method as above may comprise the steps of:

mixing said graphite particles with said silica precursor to form a first mixture;

applying said first mixture to said conductive surface; and then processing said first mixture to produce a second mixture of said graphite particles mixed with said amorphous silica.

Alternatively, such a method may comprise the steps of:

mixing said graphite particles with said silica precursor to form a first mixture;

processing said first mixture to produce a second mixture of said graphite particles mixed with said amorphous silica; and then applying said second mixture to said conductive surface of said substrate.

Said silica precursor, said first mixture or said second mixture may be applied to said conductive surface by a spinning, spraying, or a printing process.

A useful advantage of such a printing, spinning, spraying or equivalent process is that a relatively expensive plasma or vacuum coating process may be avoided.

Said printing process may be an inkjet printing process or a screen printing process.

Said silica precursor, said first mixture or said second mixture may be applied to selected locations of said conductive surface by a lift-off process.

Said silica precursor, said first mixture or said second mixture may be in the form of a liquid ink.

By an ink is meant a liquid containing the said silica precursor or amorphous silica and, in the case of said first or second mixture, said graphite particles in suspension.

Said silica precursor may be in the form of a sol-gel.

Said sol-gel may be synthesised from tetraethyl orthosilicate.

Said sol-gel may comprise silica in a propan-2-ol solvent with or without the addition of acetone.

Said silica precursor may be a soluble precursor.

Said soluble precursor may be a soluble polymer precursor.

Said soluble polymer precursor may comprise a silsequioxane polymer.

Said silsequioxane polymer may comprises β-chloroethyl-silsequioxane in solvent.

Said silica precursor may comprise a dispersion of colloidal silica.

Said silica precursor, said first mixture or said second mixture may be in the form of a dry toner.

By toner is meant either: a dry powder material that contains said silica precursor or amorphous silica and, in the case of said first or second mixture, said graphite particles; or, in the case of said first or second mixture, graphite particles already pre-coated with said silica precursor or amorphous silica, as described in our patent GB 2 304 989.

Said amorphous silica or the precursor thereof may be doped by a metal compound or metal cation.

Said metal compound may be a nitrate.

Said metal compound may be an organo-metallic compound.

Said amorphous silica may be doped by means of tin oxide or indium-tin oxide.

Said amorphous silica may be doped by means of a compound of iron and/or manganese.

Said processing of said amorphous silica may comprise heating.

Said heating may be carried out by laser.

Said processing of said amorphous silica may comprise exposure to ultraviolet radiation.

Said exposure may be in a predetermined pattern.

Said graphite particles may comprise carbon nanotubes.

Said graphite particles may comprise non-graphite particles which are coated or decorated with graphite.

Said graphite may be oriented to expose the prism planes.

Processing of said amorphous silica may be such that each of said particles has a layer of said amorphous silica disposed in a first location between said conductive surface and said particle, and/or in a second location between said particle and the environment in which the field electron emission material is disposed, such that electron emission sites are formed at at least some of said first and/or second locations.

The invention extends to a field electron emitter comprising field electron emission material that has been created by a method according to any of the preceding aspects of the invention.

The invention also extends to a field electron emission device comprising such a field electron emitter and means for subjecting said emitter to an electric field in order to cause said emitter to emit electrons.

Such a field electron emission device may comprise a substrate with an array of patches of said field electron emitters, and control electrodes with aligned arrays of apertures, which electrodes are supported above the emitter patches by insulating layers.

Said apertures may be in the form of slots.

A field electron emission device as above may comprise a plasma reactor, corona discharge device, silent discharge device, ozoniser, an electron source, electron gun, electron device, x-ray tube, vacuum gauge, gas filled device or ion thruster.

In a field electron emission device as above, the field electron emitter may supply the total current for operation of the device.

In a field electron emission device as above, the field electron emitter may supply a starting, triggering or priming current for the device.

A field electron emission device as above may comprise a display device.

A field electron emission device as above may comprise a lamp.

Said lamp may be substantially flat.

Said emitter may be connected to an electric driving means via a ballast resistor to limit current.

Said ballast resistor may be applied as a resistive pad under each said emitting patch.

Said emitter material and/or a phosphor may be coated upon one or more one-dimensional array of conductive tracks which are arranged to be addressed by electronic driving means so as to produce a scanning illuminated line.

Such a field electron emission device may include said electronic driving means.

Said field emitter may be disposed in an environment which is gaseous, liquid, solid, or a vacuum.

A field electron emission device as above may comprise a cathode which is optically translucent and is so arranged in relation to an anode that electrons emitted from the cathode impinge upon the anode to cause electro-luminescence at the anode, which electro-luminescence is visible through the optically translucent cathode.

It will be appreciated that the electrical terms "conducting" and "insulating" can be relative, depending upon the basis of their measurement. Semiconductors have useful conducting properties and, indeed, may be used in the present invention as conducting particles. In the context of this specification, each said conductive particle has an electrical conductivity at least $10^2$ times (and preferably at least $10^3$ or $10^4$ times) that of the insulating material.

The invention may have many different embodiments, and several examples are given in the following description. It is to be appreciated that, where practical, features of one embodiment or example can be used with features of other embodiments or examples.

Figure 2A:
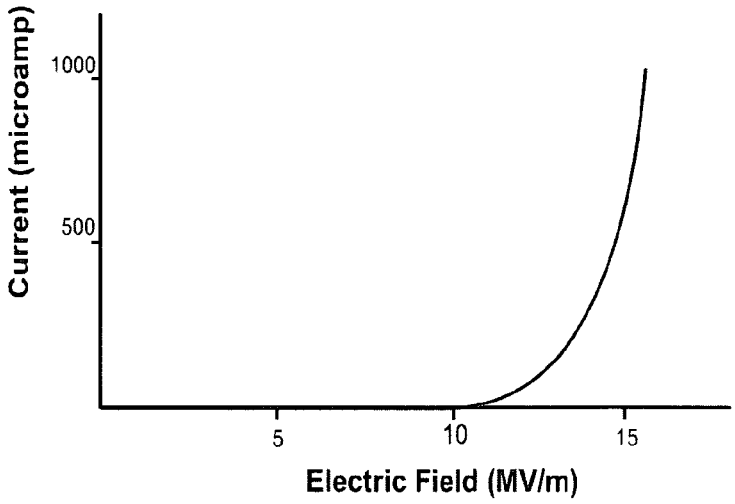
Figure 2B:
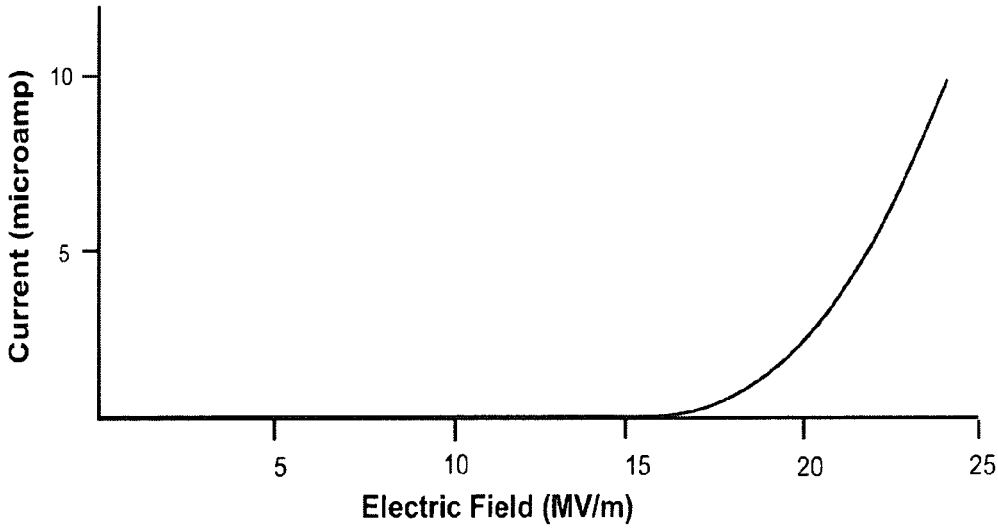
Figure 3A:
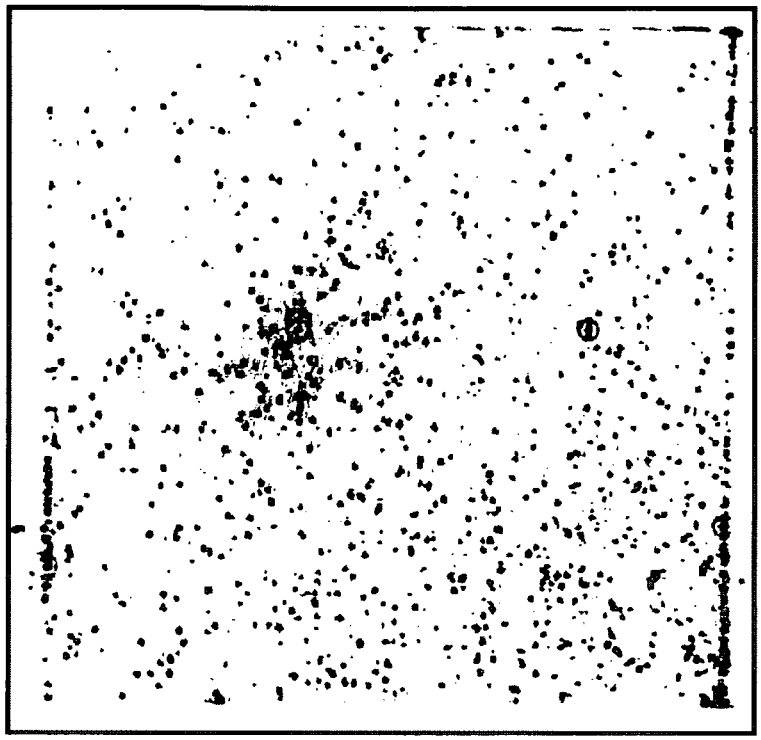
Figure 3B:
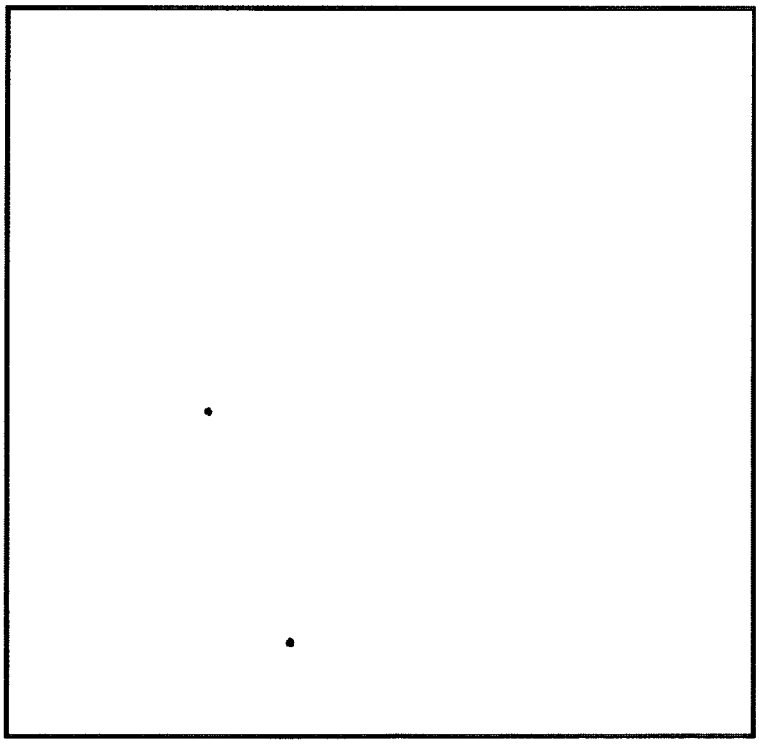
Figure 4:
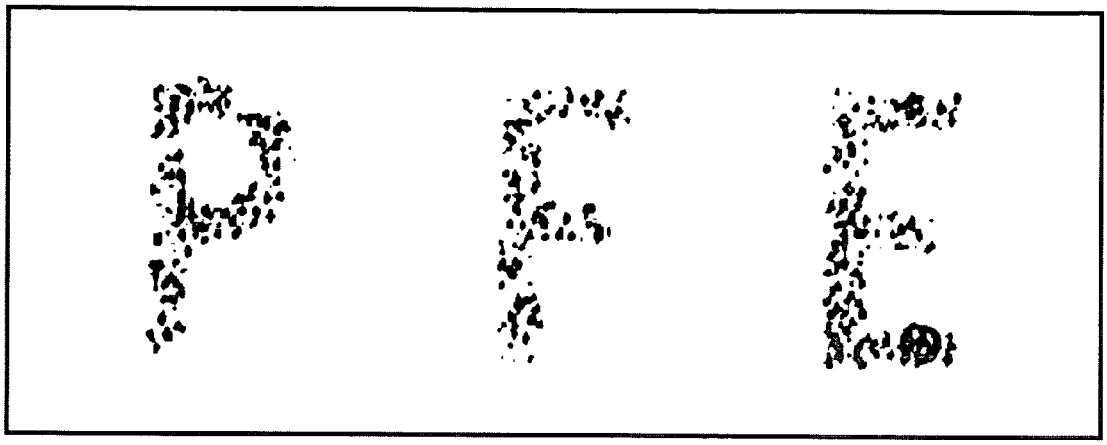

For a better understanding of the invention, and to show how embodiments of the same may be carried into effect, reference will now be made, by way of example, to the accompanying diagrammatic drawings, in which:

FIG. 1 shows a MIMIV field emitter material;

FIGS. 2*a* and 2*b* show voltage-current characteristics for two alternative cathodes;

FIGS. 3*a* and 3*b* show, for comparison, emission images for the cathodes of FIGS. 2*a* and 2*b* respectively;

FIG. 4 shows an emission image of a cathode; and

Figure 5A:
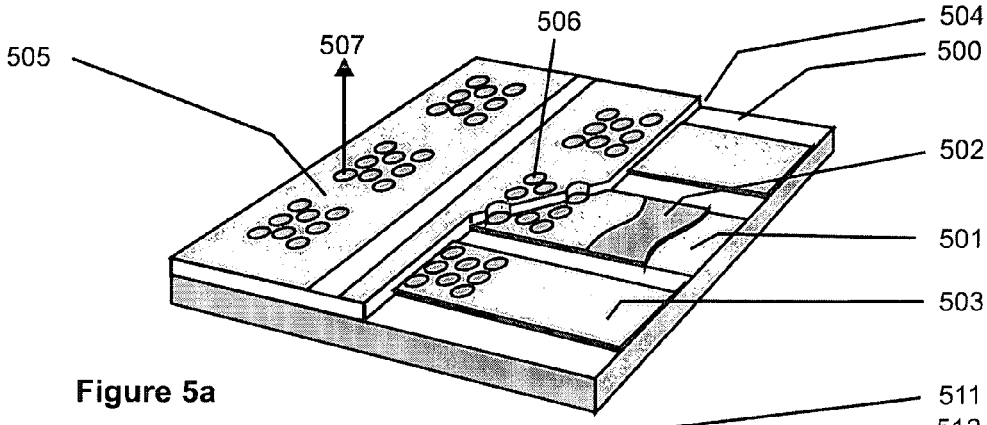
Figure 5B:
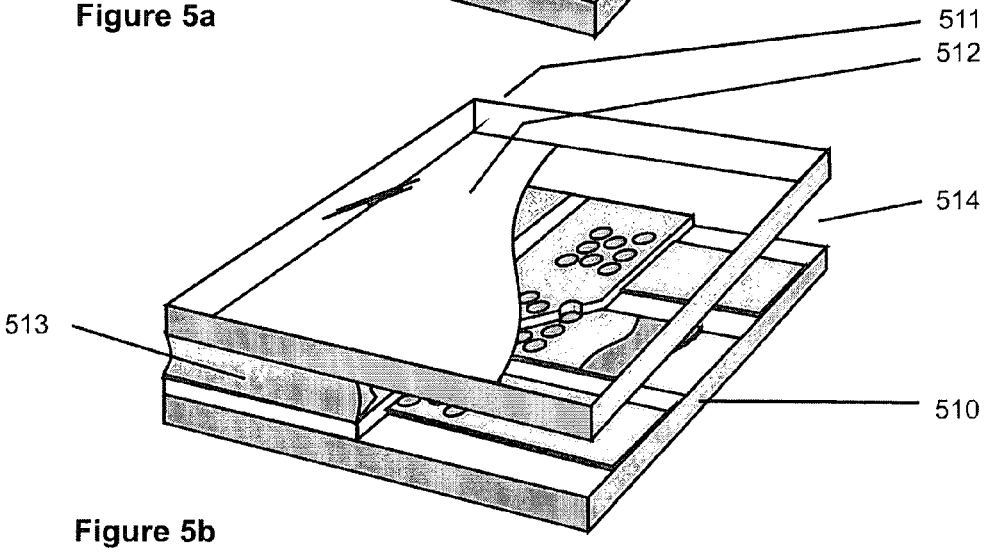
Figure 5C:
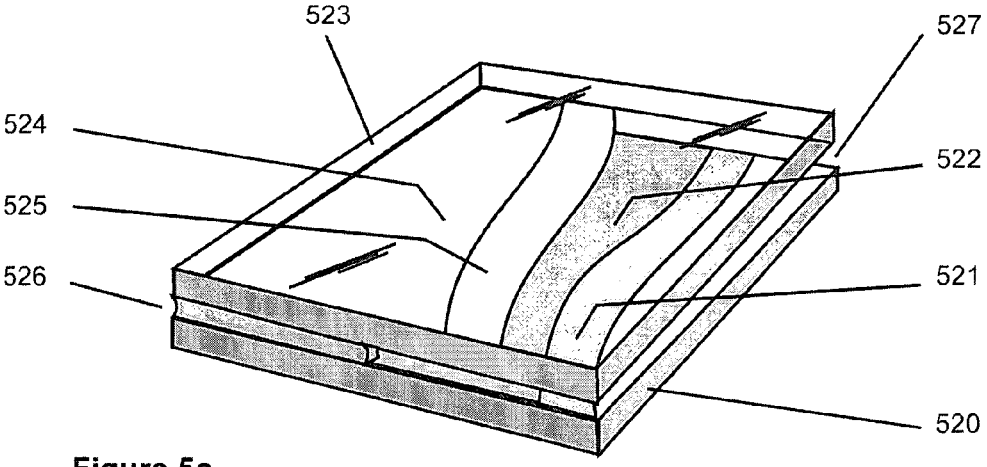

FIGS. 5*a* to 5*c* show respective examples of field-emitting devices using materials as disclosed herein.

FIG. 1 shows a MIMIV emitter material as described by Tuck, Taylor and Latham (GB 2304989) with electrically conducting particles 11 in an inorganic electrically insulating matrix 12 on an electrically conducting substrate 13. For insulating substrates 13, an electrically conducting layer 14 is applied before coating. The conducting layer 14 may be applied by a variety of means including, but not limited to, vacuum and plasma coating, electro-plating, electroless plating and ink based methods.

Whilst embodiments of the present invention are not limited to a particular emission mechanism, the emission process of the material shown in FIG. 1 is believed to occur as follows. Initially the insulator 12 forms a blocking contact between the particles 11 and the substrate. The voltage of a particle will rise to the potential of the highest equipotential it probes—this has been called the antenna effect. At a certain applied voltage, this will be high enough to create an electro-formed conducting channel 17 between the particle and the substrate. The potential of the particle then flips rapidly towards that of the substrate 13 or conducting layer 14, typically arranged as a cathode track. The residual charge above the particle then produces a high electric field which creates a second electro-formed channel 18 and an associated metal-insulator-vacuum (MIV) hot electron emission site. After this switch-on process, reversible field emitted currents 20 can be drawn from the site.

The standing electric field required to switch on the electro-formed channels is determined by the ratio of particle height 16 and the thickness of the matrix in the region of the conducting channels 15. For a minimum switch on field, the thickness of the matrix 12 at the conducting channels should be significantly less than the particle height. The conducting particles would typically be in, although not restricted to, the range 0.1 microns (micrometres) to 400 microns, preferably with a narrow size distribution.

By a "channel", "conducting channel" or "electro-formed channel" we mean a region of the insulator where its properties have been locally modified, usually by some forming process involving charge injection or heat. Such a modification facilitates the injection of electrons from the conducting back contact into the insulator such that the electrons may move through it, gaining energy, and be emitted over or through the surface potential barrier into the vacuum. In a crystalline solid the injection may be directly into the conduction band or, in the case of amorphous materials, at an energy level where hopping conduction is possible.

We have now found, surprisingly, that carefully controlled variants of amorphous silica can provide an ideal material for the insulator component in a MIMIV structure. Unlike many candidate amorphous materials, amorphous silica has a diffused (tail states that may or may not be localised) but well defined band gap and can thus have its properties modified using analogues of semiconductor engineering techniques (e.g. doping) to provide donor levels to give the material desirable n-type properties. The role of these donor levels is described in our co-pending application GB 2 340 299, to which the reader's attention is directed. It should be realised that, as with all amorphous materials, the dopant concentrations required to produce electronic effects are much higher than for crystalline materials. In some cases, alloying of the material may also occur due to the high concentration of impurities introduced into the structure. As well as the addition of dopants, the electrical properties of the silica can be modified by controlling the morphology of the film with defects in the lattice and grain boundaries to provide donors and internal field concentration points. We have found that a high quality silica film that is electrically perfect does not provide the necessary carriers/states for conduction. Furthermore, we have found that non-optimised or incorrectly processed formulations can all too easily lead to silica that is too perfect.

Silica ($SiO_2$) is a complicated polymorphic structure consisting of silicon and oxygen atoms in a tetrahedral arrangement in which the tetrahedra are joined at the corners by bridging oxygen bonds. Defect-free silica necessary implies a pure and perfect crystalline material with sharp band edges that have no tail states.

Considerable effort has been expended in the semiconductor industry to grow virtually defect-free amorphous silica films by thermally oxidising silicon. This results in an electronic grade of silica used as the gate dielectric for metal-oxide-semiconductor devices. These have a low density of defects, making them resistant to high-voltage breakdown.

On the other hand, silica deposited by plasma, sol-gel or polymeric precursor routes is amorphous with the disorder being compositional, structural or morphological. For example, it contains a much higher density of point defects, such as dangling bonds, non-bridging oxygen bonds, and hydrogen terminated bonds than thermally grown silica. This makes the material non-stoichiometric. The electrical properties of such films are determined by, among other factors, the deposition, impurity additions, and subsequent annealing. Annealing could be carried out by traditional furnaces, rapid thermal annealing or with the use of lasers.

Hence, by controlling the deposition technique and avoiding prolonged post-annealing, it is possible to controllably create heavily defective silica. Such materials can be described as having many electronic states that may, or may not, be localised such that they extend into the band-gap.

This results in wide fuzzy band-edges, often referred to as band tails, and a reduction in the overall band-gap.

Such heavily defective silica will have been avoided by the traditional electronics industry trying to grow good dielectric thin films, primarily because of its poor resistance to electrical breakdown. This property arises from a variety of charged and neutral states providing a conduction path through the material, for example by hopping conduction and ionic processes.

Silica films with the correct properties may be fabricated using sol-gel methods with the formulation of the dispersion, the coating process and the layer's subsequent heat treatment being critical to final emitter performance.

Exemplary processes for forming such sol-gels are as follows.

EXAMPLE 1

Tetraethyl orthosilicate (10 ml), and MOS grade propan-2-ol (47 ml) were mixed and cooled to 5–10° C. with stirring at 1000 r.p.m. To this stirring mixture was than added a solution of concentrated nitric acid (0.10 g) in deionised water (2.5 g). After 2 hours, the mixture was transferred to a sealed container, and stored at 4° C. in a refrigerator until required.

EXAMPLE 2

Tetraethyl orthosilicate (10 ml), acetone (13 ml), and MOS grade propan-2-ol (34 ml) were mixed and cooled to 5–10° C. with stirring at 1000 r.p.m. To this stirring mixture was then added a solution of concentrated hydrochloric acid (0.25 g) in deionised water (2.5 g). After 2 hours, the mixture was transferred to a sealed container, and stored at 4° C. in a refrigerator until required.

EXAMPLE 3

Tetraethyl orthosilicate (10 ml), acetone (13 ml), and MOS grade propan-2-ol (34 ml) were mixed and cooled to 5–10° C. with stirring at 1000 r.p.m. To this stirring mixture was then added a solution of concentrated nitric acid (0.10 g) in deionised water (2.5 g). After 2 hours, the mixture was transferred to a sealed container, and stored at 4° C. in a refrigerator until required.

The band gap of silica may be advantageously modified by the addition of, for example, tin oxide. $SnO_2$ is homologous with $SiO_2$. The band gap of silica is ~9 eV whilst that for $SnO_2$ is ~3.6 eV. Mixtures of the two materials have band gaps intermediate those of the two materials. Furthermore, $SnO_2$ is, as the result of its tendency to be oxygen deficient, an n-type material. Appropriate mixtures of $SiO_2$ and $SnO_2$ will thus advantageously have both a narrower band gap than silica alone and have n-type properties. Indium tin oxide or antimony tin oxide may also be used as an additive.

A further means by which the electronic properties of the silica may be modified is the addition of metallic cationic species into the amorphous silica network. We have found that a mixture of iron and manganese salts (e.g. nitrates) added to the sol-gel reduces the operating field of the emitter. Other metal salts and organometallic compounds may be added to produce similar effects.

An exemplary process for forming such metal doped sol-gels is as follows.

EXAMPLE 4

Tetraethylorthosilicate (10.0 ml), acetone (13 ml), and MOS grade propan-2-ol (34 ml) were mixed and cooled to 5–10° C. To this stirring mixture (1000 r.p.m.) was then added a solution of concentrated nitric acid (0.1 g), Fe(NO3) 3.9120 (0.125 g) and Mn(NO3)2.6H2O (0.125 g) in deionised water (2.5 ml). After 2 hours, the mixture was transferred to a sealed container and stored in a refrigerator at 4° C.

The use of sol-gel precursors for silica is ideal for formulating emitter inks for the formation of layers by spin coating. However, their one disadvantage is that, once dried, they are not reverse soluble in the solvent. This makes them unsuitable for many printing processes, such as inkjet and silk screen, where the jets and narrow openings in the screen will become blocked with solidified material.

Arkles (U.S. Pat. No. 5,853,808) describes the use of silsequioxane polymers as precursors for the preparation of high quality silica-rich films for use in electronic devices and therefore, as discussed herein, desirably as perfect as possible. We have found these materials to be useful alternatives to sol-gel dispersions in the formulation of emitter inks. These materials are reverse soluble in a number of solvents, for example methoxypropanol. One polymer, β-chloroethylsilsesquioxane, has been found to be particularly useful. In the case of this work processing is controlled. We have found that by carefully controlling the processing we can, unlike Arkles, produce deliberately defect-rich films.

Another useful property of formulations based upon these silsequioxane polymers is that they may be converted to silica using ultraviolet radiation as well as heat. This enables one not only to cure the films via blanket (broad area) irradiation but also to use optical lithographic techniques, including the use of cursive exposure by laser, to form patterned emitters.

Other polymer precursors can also be used.

Moving on now to the choice of particle, we have found that, surprisingly, one material, graphite, is far superior to all others.

By graphite particles we mean ones in which the so-called prism planes are exposed either at fractured edges or steps and terraces on the basal plane. Within this definition we include carbon nanotubes, preferably but not exclusively un-capped, single and multi-wall.

This preference for one particle material is surprising since, at first sight, the particle's role is primarily that of an electric field enhancing element. However, the surface of the particle forms the back contact of the MIV channel in the MIMIV emission mechanism. It is known in the art, and addressed in our co-pending application GB 2 340 299 that this surface plays an important role in the injection of electrons into an insulator layer. Furthermore, electrostatic modelling has shown us that the lower metal-insulator-metal (MIM) channel has a higher field across it prior to forming than the MIV channel and consequently the composition of its back contact (FIG. 1 13/14) is far less critical—this is confirmed by our experiments.

The preference for graphite is very specific, as other conducting forms of carbon do not show the same superior performance. For example, carbon black particles which are complex in shape (e.g. aciniform), and thus likely to provide good electric field enhancement, do not result in good emitters. This is despite the fact that the exposed surface is crystallographically very similar to the basal plane of graphite.

We speculate that the open prism planes and the steps and terraces upon the basal plane provides an atomically rough surface which enables the oxygen atoms in the silica to sit "in" the graphite surface, reducing the negative dipole that would otherwise result. This arrangement facilitates the injection of electrons from the graphite into the silica. Similar effects have been observed on thermionic dispenser cathodes (see Norman) Tuck et al *Physical Review Letters* Vol. 58, No. 5, 2$^{nd}$ February 1987 page 519). Further evidence of the special nature of graphite is that other flake-like materials, such as nickel and silver-plated nickel, are, surprisingly, significantly inferior.

Suitable graphite particles may be obtained from:

Timcal SA
Grafite e Tecnologie
CH-6743-Bodio
Switzerland

Their grades KS4, KS6 and KS15 (where the number indicates the nominal particle size in micrometres) are particularly useful. Clearly, other sources may be found by those skilled in the art.

Finely divided graphite may also be coated onto particles that have other desirable properties, for example a higher resistivity, to form composite structures. One suitable host particle is boron carbide. One method of adding such a coating is to add colloidal graphite to the emitter ink.

An exemplary processes for forming an emitter ink using graphite particles is as follows.

EXAMPLE 5

Timrex KS6 graphite (0.150 g) and a sol-gel dispersion according to Example 1 (9.850 g) previously filtered through a 0.2 micron filter were mixed, and ultrasonically agitated for 10 minutes using a high power ultrasonic probe. The sample was allowed to cool to room temperature and ultrasonically agitated for a further 10 minutes. This yielded the required ink as a black suspension. The mixture was transferred to a sealed container and stored in a refrigerator at 4° C.

EXAMPLE 6

Timrex KS6 powder (0.049 g) and Gelest Seramic Si (9.945 g) prefiltered through a 0.2 micron filter were mixed and agitated for 10 minutes using a high power ultrasonic probe. The mixture was transferred to a sealed container and stored in a refrigerator at 4° C.

Note: Gelest Seramic Si is a proprietary solution of β-chloroethyl-silsesquioxane in methoxypropanol.

Dispersants or surfactants can be used in embodiments of the invention to facilitate the dispersions of particles in the liquid media.

Exemplary processes for forming field emitting cathodes using the inks described in Examples 5 and 6 are as follows.

EXAMPLE 7

A borosilicate glass substrate is coated with gold, either by sputter coating (nichrome under-layer for adhesion) or by the use of liquid bright gold.

By liquid bright gold we mean metallic layers produced using a paint that contains organometallic compounds—the so-called resinate or bright golds, palladiums and platinums. The metallic layer is formed by applying a paint and then firing the object in air at temperatures between 480° C. and 920° C., at which point the organometallic compound decomposes to yield pure metal films 0.1 to 0.2 μm thick. Traces of metals such as rhodium and chromium are added to control morphology and assist in adhesion. Currently, most of these known products and development activity concentrate on the decorative properties of the films. However, the technology is well established. Although little (or not) used, or known of, in the field emission art today, such techniques have been used in the past by the electron tube industry. For example Fred Rosebury's classic text "*Handbook of Electron Tube and Vacuum Techniques*" originally published in 1964 (Reprinted by American Institute of Physics—ISBN 1–56396-121-0) gives a recipe for liquid bright platinum. More recently, Koroda (U.S. Pat. No. 4,098,939) describes their use for the electrodes in a vacuum fluorescent display.

The chosen ink (e.g. from the above examples) was removed from the refrigerator and allowed to warm up to room temperature. The substrate was the placed on the vacuum chuck of a spin coating machine. The substrate was spun up to coating speed (typically 3000 r.p.m to 8000 r.p.m) and flooded with MOS grade propan-2-ol as a cleaning process.

The ink was agitated just prior to application. The substrate was then run up to coating speed (typically 3000 r.p.m to 8000 r.p.m) and the ink applied with a pipette near to the centre of rotation of the substrate at the rate of 0.2 ml cm$^{-2}$ to 0.4 ml cm$^{-2}$. Following application, the substrate continued to rotate at full speed for a further 10 seconds.

After the substrates were spin coated they were transferred to hotplates under the following conditions: a) 10 minutes at 50° C.—measured surface temperature of hotplate; b) 10 minutes at 120° C.—measured surface temperature of hotplate. The substrates were then transferred to an oven (air atmosphere) according to the following profile: ambient to 450° C. at 10° C./min; isotherm at 450° C. for 120 minutes; followed by cooling naturally to room temperature. The rate and method (i.e. hotplate) of the early heating steps are critical to film integrity and emitter performance.

Following heat treatment, the emitters were ultrasonically cleaned for between 10 and 60 seconds in MOS grade propan-2-ol.

The emitters were then dried using an air duster, and placed on a hotplate for 2 minutes at 50° C. in order to remove any remaining solvent.

EXAMPLE 8

A borosilicate glass substrate is coated with a reactively sputtered layer ~1 micrometre thick of chromium oxide on a metallic chromium layer ~0.5 micrometer thick. The stoichiometry of this oxide may be adjusted to control the resistivity of the oxide film to provide resistive ballasting to control emitter site currents.

The chosen ink (e.g. from the above examples) was removed from the refrigerator and allowed to warm up to room temperature. The substrate was then placed on the vacuum chuck of a spin coating machine. The substrate was spun up to coating speed (typically 3000 r.p.m to 8000 r.p.m) and flooded with MOS grade propan-2-ol as a cleaning process.

The ink was agitated just prior to application. The substrate was then run up to coating speed (typically 3000 r.p.m to 8000 r.p.m) and the ink applied with a pipette near to the centre of rotation of the substrate at the rate of 0.2 ml cm$^{-2}$ to 0.4 ml cm$^{-2}$. Following application the substrate continued to rotate at full speed for a further 10 seconds.

After the substrates were spin coated they were transferred to hotplates under the following conditions: a) 10 minutes at 50° C.—measured surface temperature of hotplate; b) 10 minutes at 120° C.—measured surface temperature of hotplate. The substrates were then transferred to an oven (air atmosphere) according to the following profile: ambient to 450° C. at 10° C./min; isotherm at 450° C. for 120 minutes; followed by cooling naturally to room temperature. The rate and method (i.e. hotplate) of the early heating steps are critical to film integrity and emitter performance.

Following heat treatment, the emitters were ultrasonically cleaned for between 10 and 60 seconds in MOS grade propan-2-ol.

The emitters were then dried using an air duster, and placed on a hotplate for 2 minutes at 50° C. in order to remove any remaining solvent.

We have found that, provided care is taken, emitters prepared in accordance with the above methods can be patterned using a lift-off process.

An exemplary process for patterning field emitting cathodes using the inks as in Example 5 is as follows:

EXAMPLE 9

1. Substrates with conducting coatings were cleaned in an ultrasonic bath in MOS grade acetone for 1 minute, holding the substrates with plastic tweezers, and moving the beaker containing the acetone around the bath. Both sides of the substrates were then rinsed with a jet of MOS grade propan-2-ol and dried with an airduster. The substrates were then dried on a hotplate at 50° C. for a few minutes.
2. The substrates were then cleaned with an oxygen plasma in an Oxford Plasma Technology RIE80 at 100 Watts power, 200 mtorr pressure, 35 sccm oxygen for one minute.
3. JSR resist type IX500 was then spun onto the substrate—2 ml of resist was pipetted onto the slide which was then spun at 1000 rpm for ≈5 seconds and then 300 rpm for ≈50 seconds.
4. The resist was then baked for 2 minutes on a hotplate at 100° C. and the substrate allowed to cool.
5. Exposure of the resist was carried out with a chrome/glass mask on a SET mask aligner. The exposure time was 15 seconds (30 mW $cm^{-2}$ $s^{-1}$).
6. The substrates were then baked again on a hotplate at 100° C. for 2 minutes.
7. The pattern was then developed in JSR developer type TMA238WA for 20 seconds. The slides were rinsed with deionised water and then blow dried with nitrogen.
8. A hard bake was then carried out in an oven at 140° C. for 10 minutes.
9. A descum process was then carried out on the substrates in an Oxford Plasma Technology RIE80 at 50 Watts power, 200 mtorr pressure, 35 sccm oxygen for 0.7 minute. By "descum" is meant a cleaning step to promote adhesion, such as but not limited to an oxygen plasma etch, that removes any traces of photoresist chemicals from the areas where the emitter patches are to be coated.
10. The ink as described in Example 5 was removed from the refrigerator and allowed to warm up to room temperature. The substrate was then placed on the vacuum chuck of a spin coating machine.
11. The ink was agitated just prior to application. The substrate was then run up to coating speed (typically 3000 r.p.m to 8000 r.p.m) and the ink applied with a pipette near to the centre of rotation of the substrate at the rate of 0.2 ml $cm^{-2}$ to 0.4 ml $cm^{-2}$. Following application the substrate continued to rotate at full speed for a further 10 seconds.
12. After the substrates were spin coated they were transferred to hotplates under the following conditions: a) 10 minutes at 50° C.—measured surface temperature of hotplate; b) 10 minutes at 120° C.—measured surface temperature of hotplate.
13. cFor the lift-off process the substrate was held with plastic tweezers in MOS grade acetone in the ultrasonic bath for 10–20 seconds whilst moving it around.
14. The substrate was then rinsed on both sides with MOS grade acetone and then with MOS grade propan-2-ol. It was dried with an airduster and put on the hotplate at 50° C. to ensure it was completely dried.
15. Inspection micrographs were then recorded on a metallographic microscope.
16. The substrates were then transferred to an oven (air atmosphere) according to the following profile: ambient to 450° C. at 10° C./min; isotherm at 450° C. for 120 minutes; followed by cooling naturally to room temperature.
17. Following heat treatment, the emitters were ultrasonically cleaned for between 10 and 60 seconds in MOS grade propan-2-ol.

FIG. 4 shows an emission image of a cathode patterned using the above technique—the letters are 6 mm high. For clarity of view and to facilitate reproduction, the view of FIG. 4 is shown in reverse video—that is, original light spots against a dark background are shown in FIG. 4 as dark spots against a light background.

All of the processes described herein are merely examples that can be changed or adapted by someone skilled in the art without deviating from the teachings of this invention. Although examples are given above of a MIMIV emission mechanism, other embodiments of the invention may operate by other emission mechanisms, including MIV mechanisms.

In all of the above examples, the resultant silica is amorphous silica which is doped and/or is heavily defective. An important feature of the processing of the silica precursor, whether by heating, ultra-violet exposure or other means, is that processing is not continued until the silica precursor has been processed as far as it can, into a highly dense state. On the contrary, processing is carefully controlled to ensure that the resultant amorphous silica is not processed into its densest possible state, but is heavily defective.

To illustrate the differences between graphite and non-ideal particles, FIG. 2*a* shows voltage-current characteristics for a cathode made using the ink described in Example 5, and FIG. 2*b* shows one in which, all other factors being equal, the graphite has been replaced with angular titanium diboride particles of similar resitivity. Both dispersions were coated and processed according to Example 7. To obtain the data, the 26 mm square samples were mounted 0.25 mm away from a tin oxide coated glass anode. The voltage applied to the diode was varied under computer control, with images of the electron bombardment induced fluorescence on the tin oxide coated anode being viewed by a CCD camera. FIG. 2*a* shows a plot for an emitter containing the KS6 graphite, whilst FIG. 2*b* shows data for the titanium diboride sample. Note the need for a higher field and the dramatically reduced current (different scale) in FIG. 2*b*.

FIG. 3 compares emission images captured by the CCD camera for the cathodes containing graphite FIG. 3*a*) and titanium diboride (FIG. 3*b*). Note that many hundreds of emitters sites are visible in FIG. 3*a*, whilst there are only two in FIG. 3*b*. The field of view is 26 mm×26 mm. For clarity of view and to facilitate reproduction, the views of FIGS. 3*a* and 3*b* are shown in reverse video—that is, original light spots against a dark background are shown in the figures as dark spots against a light background.

Improved emitter materials embodying the invention may be used also in MIV devices (see, for example, our patent application GB 2 332 089), and where conductive "particles" are provided by particle-like projections or tips fabricated on a substrate and coated with an insulating layer. In embodiments of the invention, the conducting substrate, or conducting layer on the substrate, may be of graphite.

The field electron emission current available from improved emitter materials such as are disclosed above may be used in a wide range of devices including (amongst others): field electron emission display panels; lamps; high power pulse devices such as electron MASERS and gyrotrons; crossed-field microwave tubes such as CFAs; linear beam tubes such as klystrons; flash x-ray tubes; triggered spark gaps and related devices; broad area x-ray sources for sterilisation; vacuum gauges; ion thrusters for space vehicles and particle accelerators.

Examples of some of these devices are illustrated in FIGS. 5*a*, 5*b* and 5*c*.

FIG. 5*a* shows an addressable gated cathode as might be used in a field emission display. The structure is formed of an insulating substrate 500, cathode tracks 501, emitter layer 502, focus grid layer 503 electrically connected to the cathode tracks, gate insulator 504, and gate tracks 505. The gate tracks and gate insulators are perforated with emitter cells 506. A negative bias on a selected cathode track and an associated positive bias on a gate track causes electrons 507 to be emitted towards an anode (not shown).

The reader is directed to our co-pending application GB 2 330 687 (97 22258.2) for further details of constructing Field Effect Devices.

The electrode tracks in each layer may be merged to form a controllable but non-addressable electron source that would find application in numerous devices.

FIG. 5*b* shows how the addressable structure 510 described above may joined with a glass fritt seal 513 to a transparent anode plate 511 having upon it a phosphor screen 512. The space 514 between the plates is evacuated, to form a display.

Although a monochrome display has been described, for ease of illustration and explanation, it will be readily understood by those skilled in the art that a corresponding arrangement with a three-part pixel may be used to produce a colour display.

FIG. 5*c* shows a flat lamp using one of the above-described materials. Such a lamp may be used to provide backlighting for liquid crystal displays, although this does not preclude other uses, such as room lighting.

The lamp comprises a cathode plate 520 upon which is deposited a conducting layer 521 and an emitting layer 522. Ballast layers as mentioned above (and as described in our other patent applications mentioned herein) may be used to improve the uniformity of emission. A transparent anode plate 523 has upon it a conducting layer 524 and a phosphor layer 525. A ring of glass fritt 526 seals and spaces the two plates. The interspace 527 is evacuated.

The operation and construction of such devices, which are only examples of many applications of embodiments of this invention, will readily be apparent to those skilled in the art. An important feature of preferred embodiments of the invention is the ability to print an emitting pattern, thus enabling complex multi-emitter patterns, such as those required for displays, to be created at modest cost. Furthermore, the ability to print enables low-cost substrate materials, such as glass to be used; whereas micro-engineered structures are typically built on high-cost single crystal substrates. In the context of this specification, printing means a process that places or forms an emitting material in a defined pattern. Examples of suitable processes are (amongst others): screen printing, Xerography, photolithography, electrostatic deposition, spraying, ink jet printing and offset lithography.

Devices that embody the invention may be made in all sizes, large and small. This applies especially to displays, which may range from a single pixel device to a multi-pixel device, from miniature to macro-size displays.

In this specification, the verb "comprise" has its normal dictionary meaning, to denote non-exclusive inclusion. That is, use of the word "comprise" (or any of its derivatives) to include one feature or more, does not exclude the possibility of also including further features.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A method of creating a field electron emission material, comprising the steps of:

a. applying a silica precursor to graphite particles;

b. processing said silica precursor to produce amorphous silica which is doped and/or is heavily defective; and c. disposing said graphite particles upon an electrically conductive surface of a substrate such that they are at least partially coated with said amorphous silica.

2. A method according to claim 1, wherein said graphite particles are formed as projections or tips fabricated on said conductive surface.

3. A method according to claim 1, comprising the steps of a. mixing said graphite particles with said silica precursor to form a first mixture;

b. applying said first mixture to said conductive surface; and then c. processing said first mixture to produce a second mixture of said graphite particles mixed with said amorphous silica.

4. A method according to claim 1, comprising the steps of a. mixing said graphite particles with said silica precursor to form a first mixture;

b. processing said first mixture to produce a second mixture of said graphite particles mixed with said amorphous silica; and then c. applying said second mixture to said conductive surface of said substrate.

5. A method according to claim 1, wherein said silica precursor, a first mixture of said graphite particles with said silica precursor, or a second mixture of said graphite particles mixed with said amorphous silica is applied to said conductive surface by a spinning process.

6. A method according to any claim 1, wherein said silica precursor, a first mixture of said graphite particles with said silica precursor, or a second mixture of said graphite particles mixed with said amorphous silica is applied to said conductive surface by a spraying process.

7. A method according to claim 1, wherein said silica precursor, a first mixture of said graphite particles with said silica precursor, or a second mixture of said graphite particles mixed with said amorphous silica is applied to said conductive surface by a printing process.

8. A method according to claim 1, wherein said silica precursor, a first mixture of said graphite particles with said silica precursor, or a second mixture of said graphite particles mixed with said amorphous silica is applied to selected locations of said conductive surface by a lift-off process.

9. A method according claim 1, wherein said silica precursor, a first mixture of said graphite particles with said silica precursor, or a second mixture of said graphite particles mixed with said amorphous silica is in the form of a liquid ink.

10. A method according to claim 1, wherein said silica precursor comprises a sol-gel.

11. A method according to claim 10, wherein said sol-gel is synthesised from tetraethyl orthosilicate.

12. A method according to claim 11, wherein said sol-gel comprises silica in a propan-2-ol solvent.

13. A method according to claim 12, wherein said sol-gel comprises silica in a propan-2-ol solvent with the addition of acetone.

14. A method according to claim 1, wherein said silica precursor is a soluble precursor.

15. A method according to claim 14, wherein said silica precursor is a soluble polymer precursor.

16. A method according to claim 15, wherein said soluble polymer precursor comprises a silsequioxane polymer.

17. A method according to claim 16, wherein said silsequioxane polymer comprises β-chloroethylsilsequioxane in solvent.

18. A method according to claim 1, wherein said silica precursor comprises a dispersion of colloidal silica.

19. A method according to claim 1, wherein said silica precursor, a first mixture of said graphite particles with said silica precursor, or a second mixture of said graphite particles mixed with said amorphous silica is in the form of a dry toner.

20. A method according to claim 1, wherein said amorphous silica or the precursor therefor is doped by a metal compound or metal cation.

21. A method according to claim 20, wherein said metal compound is a nitrate or an organo-metallic compound.

22. A method according to claim 20, wherein said amorphous silica is doped by means of tin oxide or indium-tin oxide.

23. A method according to 20, wherein said amorphous silica is doped by means of a compound of iron and/or manganese.

24. A method according to claim 1, wherein said processing of said amorphous silica comprises heating.

25. A method according to claim 24, wherein said heating is carried out by laser.

26. A method according to claim 1, wherein said processing of said amorphous silica comprises exposure to ultraviolet radiation.

27. A method according to claim 26, wherein said exposure is in a predetermined pattern.

28. A method according to claim 1, wherein said graphite particles comprise carbon nanotubes.

29. A method according to claim 1, wherein said graphite particles comprise non-graphite particles which are coated with graphite.

30. A method according to claim 29, wherein said graphite is oriented to expose prism planes.

31. A method according to claim 1, wherein processing of said amorphous silica is such that each of said particles has a layer of said amorphous silica disposed in a first location between said conductive surface and said particle, and/or in a second location between said particle and the environment in which the field electron emission material is disposed, such that electron emission sites are formed at at least some of said first and/or second locations.

32. A method according to claim 1, wherein said graphite particles comprise non-graphite particles which are decorated with graphite.

33. A method according to claim 1, wherein said ink is applied to said conductive surface by a spinning process.

34. A method according to claim 1, wherein said ink is applied to said conductive surface by a spraying process.

35. A method according to claim 1, wherein said ink is applied to said conductive surface by a printing process.

36. A method according to claim 1, wherein said ink is applied to said conductive surface by a lift-off process.

37. A method according to claim 7, wherein said printing process is an inkjet printing process.

38. A method according to claim 7, wherein said printing process is a screen printing process.

* * * * *